US005749753A

United States Patent [19]

Chishima et al.

[11] Patent Number: 5,749,753

[45] Date of Patent: May 12, 1998

[54] JOINT CONNECTOR

[75] Inventors: Masamitsu Chishima; Tomonari Ito, both of Yokkaichi, Japan

[73] Assignee: Sumitomo Wiring Systems, Ltd., Japan

[21] Appl. No.: 654,195

[22] Filed: May 28, 1996

[30] Foreign Application Priority Data

Jun. 6, 1995 [JP] Japan ..... 7-164651

[51] Int. Cl.[6] ..... H01R 13/514

[52] U.S. Cl. ..... 439/752.5

[58] Field of Search ..... 439/189, 595, 439/752.5, 744, 746, 748, 872

[56] References Cited

U.S. PATENT DOCUMENTS

| | | | |
|---|---|---|---|
| 4,969,841 | 11/1990 | Sueyoshi et al. | 439/595 |
| 5,004,434 | 4/1991 | Aiello et al. | 439/746 |
| 5,066,252 | 11/1991 | Kato et al. | 439/595 |
| 5,326,287 | 7/1994 | Hamakita et al. | 439/752 |
| 5,403,204 | 4/1995 | Chishima et al. | 439/513 |
| 5,496,188 | 3/1996 | Okamura et al. | 439/189 |
| 5,618,207 | 4/1997 | Maejima | 439/595 |
| 5,628,652 | 5/1997 | Ohsumi | 439/595 |

*Primary Examiner*—Neil Abrams
*Assistant Examiner*—Katrina Davis
*Attorney, Agent, or Firm*—Jordan B. Bierman; Bierman, Muserlian and Lucas

[57] ABSTRACT

A joint connector including a terminal and a connector housing. The terminal is provided with a pair of upstanding walls extending longitudinally of the terminal and spaced apart from each other. A resilient tongue is located between the walls and protrudes upwardly therefrom. This portion of the terminal fits into a corresponding receptacle in the connector housing. One of the two walls is shorter than the other and the receptacle has a similar configuration. Thus, when the terminal is inserted in proper orientation, the short wall matches the short portion of the receptacle opening and the terminal can be easily introduced. However, if the terminal is reversed, the high wall will be in contact with the short opening and entry will be prevented. In this manner, an opportunity for misassembly and consequent undesired deformation of the contact tongue are eliminated.

11 Claims, 5 Drawing Sheets

JOINT CONNECTOR

This Application claims the benefit of the priority of Japanese Application 7-164651, filed Jun. 6, 1995.

The present Invention is directed to a joint connector capable of receiving a plurality of terminals and consists of a connector housing and a conductive plate for making contact therewith.

BACKGROUND OF THE INVENTION

A typical prior art connector is shown in FIGS. 6 and 7 and has been disclosed in Japanese Unexamined Patent Publication 6/333628. Terminal 1 comprises side walls 2 with contact tongue 3 located therebetween and protruding vertically upwardly therefrom. This end of terminal 1 is intended to be inserted into cavity 5 of connector housing 4. In the example shown, housing 4 has two superposed rows of cavities 5. Openings 8 are adapted to receive conductive plate 6 carrying a plurality of contacts. Each tongue 3 is adapted to, upon insertion of terminal 1 into one of cavities 5, make contact therewith.

As the device is assembled, conductive plate 6 is inserted into plate housing area 7 located in each cavity 5. Since tongue 3 protrudes resiliently from between side walls 2, insertion thereof into cavity 5 causes tongue 3 to press firmly against conducting plate 6, thereby providing good electrical contact.

Devices of the foregoing type, however, have certain disadvantages. Specifically, terminal 1 is capable of being inverted and inserted into cavities 5. When this is done, tongue 3 is over deflected and may be permanently damaged. Such a deformed connector must be discarded.

SUMMARY OF THE INVENTION

It is, therefore, an object of the present Invention to provide a device of the foregoing type which can prevent unwanted deformation or deflection of the tongue. In order to accomplish this, there is provided a joint connector comprising a terminal and a connector housing. The terminal has a front portion, which faces the connector housing, and a rear portion, facing in the opposite direction. The front portion is provided with a first upstanding wall and a second upstanding wall. The first wall extends longitudinally of the terminal toward the rear portion. The second wall is substantially parallel to the first wall and is spaced laterally apart therefrom.

The connector housing is provided with a receptacle (preferably a plurality thereof) adapted to receive the front portion of the terminal in proper predetermined orientation. It is a feature of the present Invention that the first upstanding wall is lower than the second wall. Complementary thereto, the receptacle has a low portion and a high portion, the former being adapted to receive the first wall while the latter is adapted to receive the second wall.

However, if the assembler attempts to insert the terminal upside down, the second wall will now be in the low portion of the receptacle. Since the height is greater than the low portion the terminal cannot be inserted. Thus, the present Invention prevents misassembly of the device, as well as unwanted deformation which would otherwise accompany it.

In a preferred form of the device, the two walls are located against corresponding inner side surfaces of the receptacle. The resilient tongue extends out of the space between the walls, thereby being capable of making good electrical contact.

In most cases, the joint connector will have a plurality of terminals and a plurality of receptacles. The latter are usually arranged in two horizontal rows, one superposed on the other, with a gap between the two rows.

There is also provided a conductive plate which fits into the aforementioned gap. Thus, when the device is completely assembled, the tongue, by virtue of its protrusion from between the walls, presses firmly against the conductive plate, thereby insuring good contact. The conductive plate is advantageously provided with a plurality of contacts, preferably one for each vertical pair of receptacles.

It has been found desirable to provide, at the lower edge of the second wall, a downwardly projecting tab. This assists in differentiating the height of the second wall from that of the first wall and enables the low portion of the receptacle to reject the second wall more affirmatively.

In combination with the foregoing, there may be provided a guide groove within the receptacle, which receives the tab and permits it to slide into the assembled position. This groove may be in an inner surface of the receptacle or in a resilient lance located therein. In the latter case, a further hole may be provided near the inner end so that, when assembly is complete, the tab projects through the hole and locks the terminal in place.

The rear portion of the terminal carries a barrel which is adapted to grip a cable to be connected thereto. The conductive portion of the cable is electrically in contact with the tongue.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
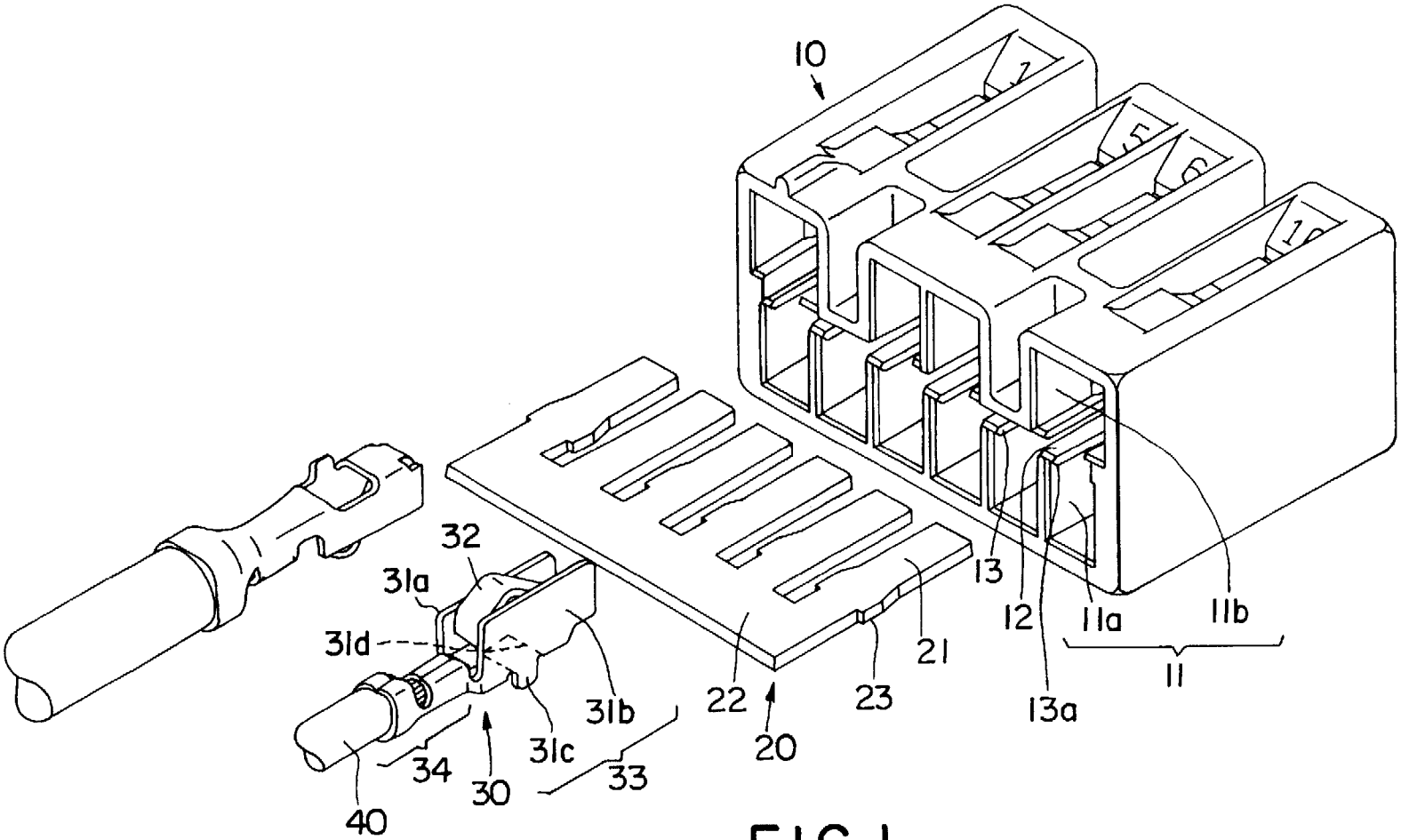
FIG. 1 is an exploded perspective view showing the various elements of the present Invention.

Referring to FIG. 1, the joint connector of the present Invention comprises connector housing 10, conductive plate 20, terminals 30, and cables 40 attached to the rear portion thereof. The latter includes barrel 34 which grips both the insulated and conductive portions of cable 40. Front portion 33 carries low wall **31*a* and high wall 31*b*. Between these walls is tongue 32 which protrudes therefrom. Tab 31*c* is located at the base of wall 31*b*. Locking hole 31*d* serves to assist in retaining terminal 30 in connector housing 10**.

Connector housing 10 is provided with receptacles 11, arranged in lower row **11*a* and upper row 11*b*. Gap 12 is between rows 11*a* and 11*b*. Conductive plate 20 comprises spine 22 and plate contacts 21. For locking purposes, noses 23 are provided on the shanks of plate contacts 21**.

Figure 2:
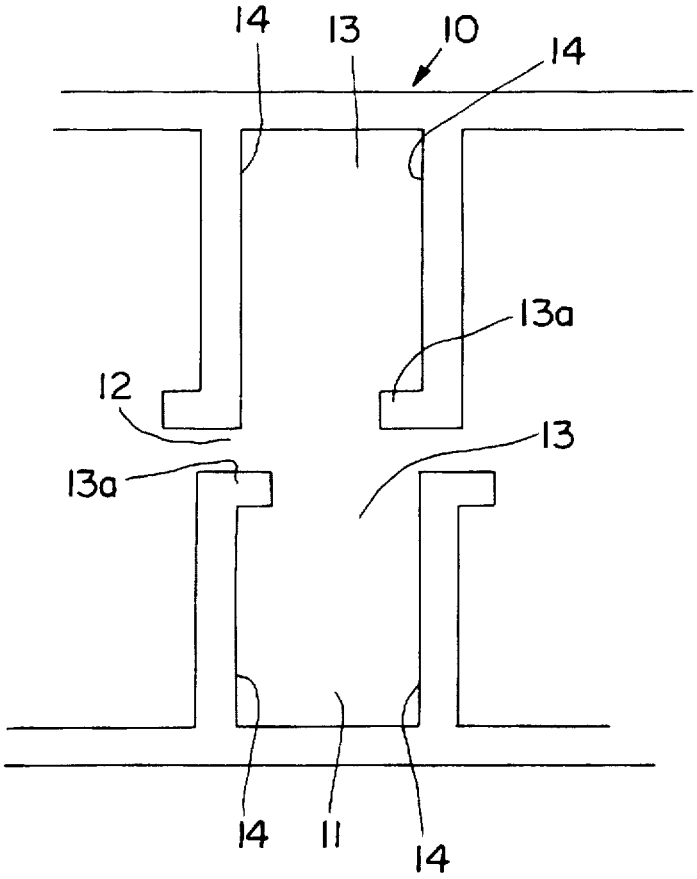
FIG. 2 is an enlarged detail of one of the receptacles of the connector housing.
Figure 3:
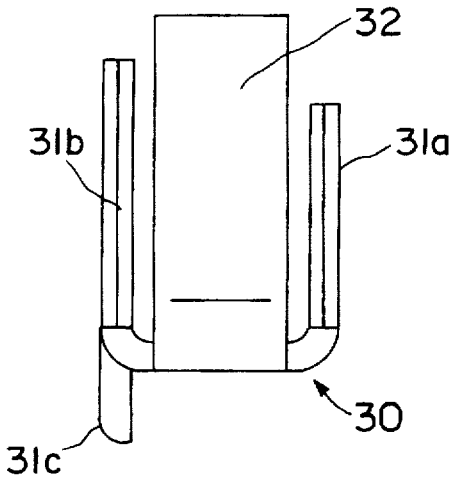
FIG. 3 is a view looking at the front face of the terminal.

As shown in FIGS. 2 and 3, openings 13 are defined by side walls 14 and narrowed by bar **13*a*. Thus, the distance between bars 13***a* and the inner surface of the top or bottom wall of housing 10 is less than the height of wall 31*b*, but no smaller than the height of wall 31*a*. Hence, if terminal 30 is properly oriented, wall 31*a* fits against the left inner surface (as shown in FIG. 2) of lower receptacle 11. However, if terminal 30 is reversed, wall 31*b* is too high to fit between bar 13*a* and the bottom of the lower face; therefore, terminal 30 cannot be improperly inserted. This prevents misassembly and also avoids distortion of tongue 32.

Of course, upper row 11*b* would receive terminals 30 with wall 31*a* against the right-hand inner surface as shown in FIG. 2. Here, too, if terminal 30 is reversed, there is insufficient space between bar 13*a* and the inner surface of the top of housing 10 to permit entry.

Figure 4:
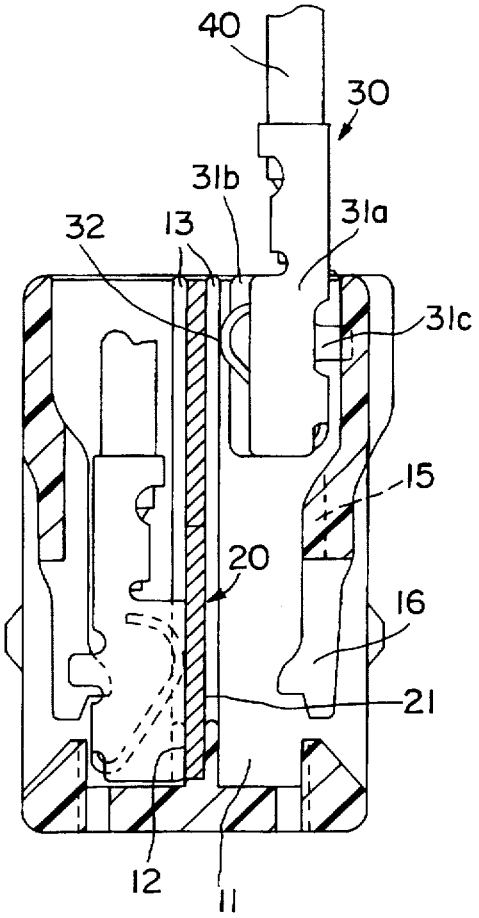
FIG. 4 is a fragmentary sectional view of the joint connector with one terminal fully inserted and a second terminal partially inserted.

In FIG. 4, one terminal 30 has been fully inserted with tongue 32 (in dotted lines) bearing against conductive plate 20 and making good electrical contact therewith. A second terminal 30 (attached to cable 40) has been partially inserted. Tongue 32 bears against conductive plate 20. Since the orientation shown is correct, terminal 30 will be introduced fully into receptacle 11 so that it is in a position corresponding to the other terminal 30 already inserted. Tab 31*c* enters guide groove 15 and, as terminal 30 reaches its final position, extends into a hole in resilient lance 16.

Figure 5:
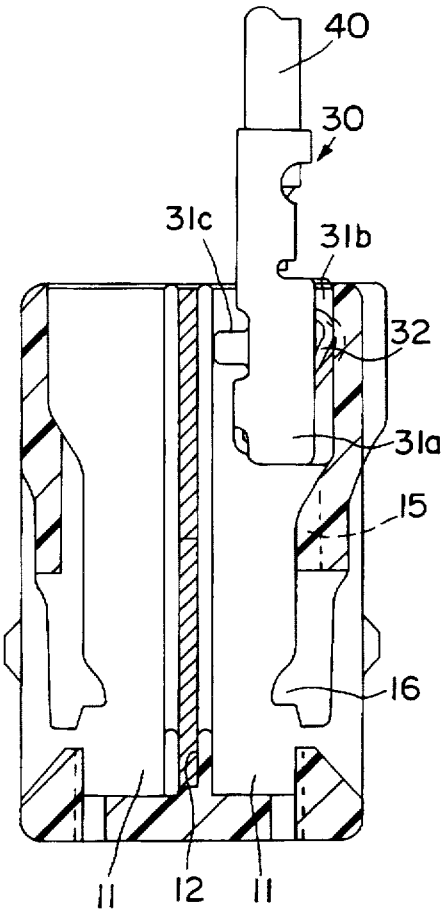
FIG. 5 is a view similar to that of FIG. 4 showing an attempt to introduce the terminal upside down.
Figure 6:
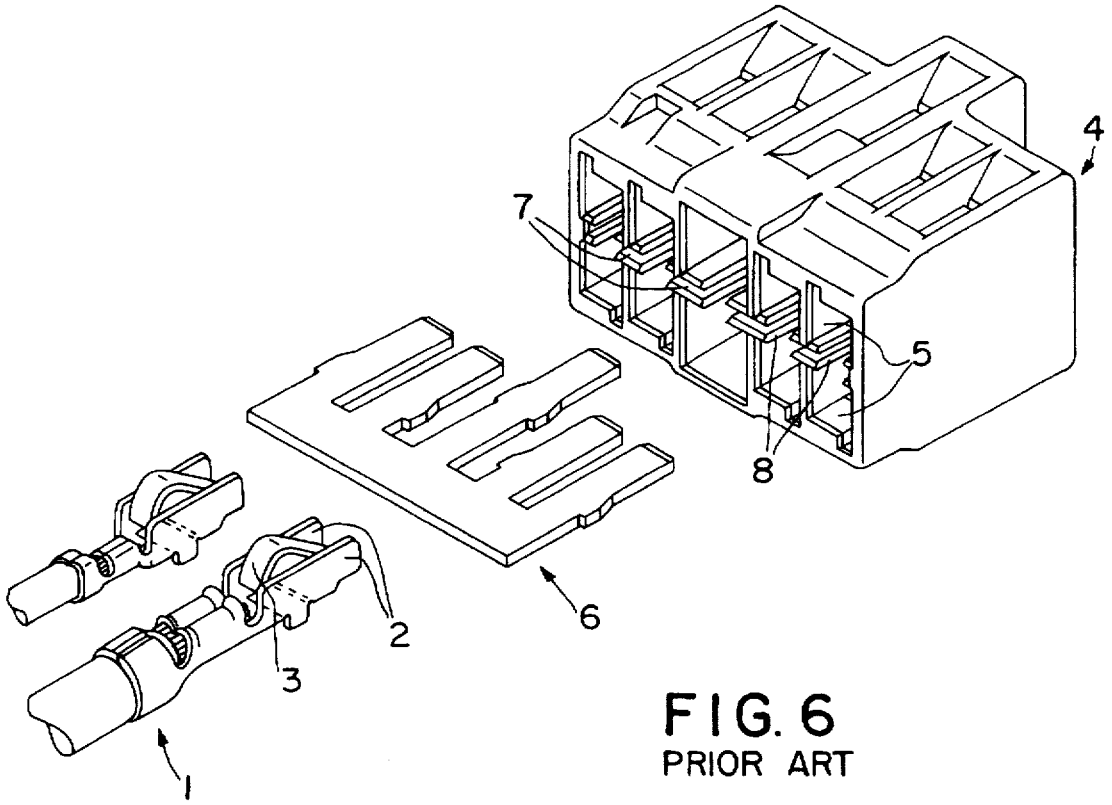
FIG. 6 PRIOR ART
FIG. 6 is a view like that of FIG. 1 showing a prior art device.
Figure 7:
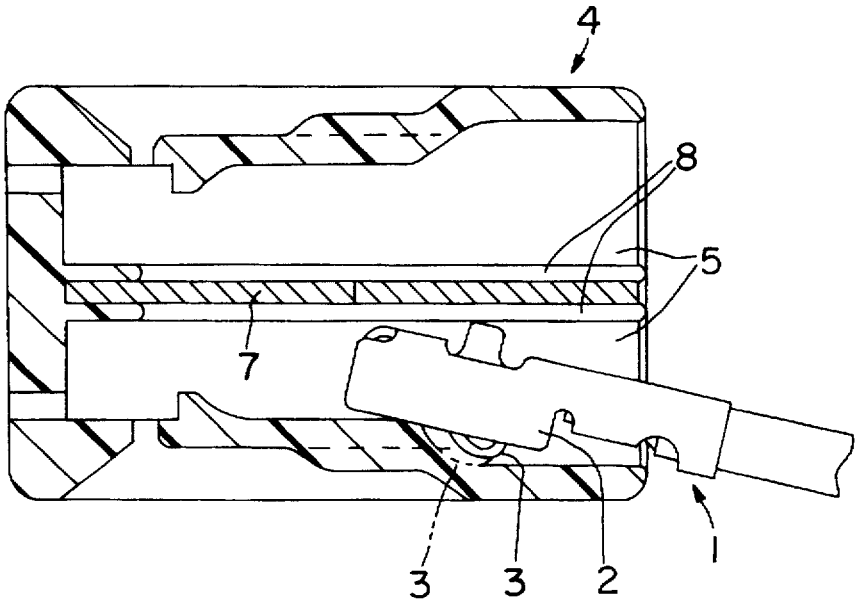
FIG. 7 PRIOR ART
FIG. 7 is a view similar to that of FIG. 5 showing a prior art device.

In FIG. 5, an attempt is shown to introduce terminal 30 incorrectly. Tab 31*c* bears against the conductive plate and the opening to receptacle 11 is of insufficient height to accept wall 31*b*. Therefore, the front portion of terminal 30 cannot be introduced into receptacle 11, thus avoiding damage and misassembly.

Although certain embodiments of the present Invention have been expressly disclosed, it is, nonetheless, to be broadly construed, and not to be limited except by the character of the claims appended hereto.

What we claim is:

1. A joint connector assembly comprising a terminal and a connector housing said terminal having a front portion, facing said connector housing, and a rear portion, facing away from said connector housing, said front portion including a first upstanding wall and a second upstanding wall, said first wall extending longitudinally of said terminal toward said rear portion, said second wall being substantially parallel to and laterally spaced apart from said first wall, thereby forming a space therebetween, said connector housing having a receptacle for said terminal adapted to receive said front portion with said first wall and said second wall in a predetermined orientation, said first wall being lower than said second wall, said receptacle having a low portion, complementary to said first wall, and a high portion complementary to said second wall when said terminal is in said predetermined orientation, said low portion being lower than said second wall whereby, if said terminal is in other than said predetermined orientation, it cannot be introduced into said receptacle, a resilient tongue in said space and extending vertically out of said space when no downward pressure is exerted thereon, whereby contact is obtained between said tongue and an adjacent portion of said housing.

2. The joint connector assembly of claim 1 wherein said low portion is adjacent one wall of said receptacle and is adapted to receive said first wall in said predetermined orientation.

3. The joint connector assembly of claim 1 wherein there is a plurality of said terminals spaced vertically apart from each other, thereby forming a gap therebetween.

4. The joint connector assembly of claim 3 comprising a conductive plate having a plate contact, which is adapted to enter said gap and bear against a resilient tongue located in said space when said terminal is in said predetermined orientation.

5. The joint connector assembly of claim 1 wherein a bottom extends between said first wall and said second wall, said first wall, said second wall, and said bottom forming a U shaped cross section.

6. The joint connector assembly of claim 4 wherein there are a plurality of receptacles in a first horizontal row and said plurality of receptacles in a second horizontal row, said second row being vertically adjacent said first row so that, between each vertical pair of receptacles, there is said gap.

7. The joint connector assembly of claim 6 wherein said conductive plate has a number of plate contacts corresponding to said plurality of receptacles, each of said contacts adapted to enter one said gap and bear against said resilient tongue in said space when said terminal is in said predetermined orientation.

8. The joint connector assembly of claim 2 wherein said second wall has a downwardly projecting tab, said tab bearing against a lower horizontal wall of said receptacle, thereby preventing insertion of said front portion, when said terminal is in other than said predetermined orientation.

9. The joint connector assembly of claim 8 wherein there is a guide groove inside said receptacle, said tab adapted to slide in said guide groove as said front portion is inserted into said receptacle.

10. The joint connector assembly of claim 8 comprising a resilient lance in said receptacle and having an opening therein, said tab in said opening when said terminal is in said receptacle.

11. The joint connector assembly of claim 1 wherein said rear portion is provided with a barrel which retains a cable, said resilient tongue being electrically connected to said cable.

* * * * *